United States Patent [19]

Eng, Jr. et al.

[11] Patent Number: 4,857,878

[45] Date of Patent: Aug. 15, 1989

[54] MODULAR HIGH FREQUENCY POWER TRANSFORMER

[76] Inventors: Benjamin Eng, Jr., 13215 Hwy. 99 South, Everett, Wash. 98204; Margaret E. Winsor, 10576 15th NW., Seattle, Wash. 98177

[21] Appl. No.: 145,365

[22] Filed: Jan. 19, 1988

[51] Int. Cl.[4] ..... H01F 15/10; H01F 27/30

[52] U.S. Cl. ..... 336/192; 336/198; 336/210

[58] Field of Search ..... 336/192, 198, 208, 210, 336/65; 310/194; 242/118.41

[56] References Cited

U.S. PATENT DOCUMENTS 4,234,865 11/1980 Shigehana ..... 336/198 X 4,250,479 2/1981 Bausch et al. ..... 336/208

*Primary Examiner*—Thomas J. Kozma

[57] ABSTRACT

A miniature high frequency power transformer comprises first and second "E" shaped ferrite core halves surrounding mating inner and outer modular transformer bobbins having formed thereon respectively the primary and secondary windings of the transformer. The inner and outer modular transformer bobbins are positioned such that the inner transformer bobbin is inserted into the outer transformer bobbin with the secondary windings surrounded by the primary windings. When assembled, the inner modular transformer bobbin has a protrusion that extends axially therefrom through the outer bobbin and terminates in first core retaining ears at one end of the transformer. Second core retaining ears extend from the opposite end of the transformer, and both ears receive the "E" shaped core halves, maintained in position on the transformer by bonding.

9 Claims, 2 Drawing Sheets

MODULAR HIGH FREQUENCY POWER TRANSFORMER

TECHNICAL FIELD

The present invention relates generally to power transformers and more particularly to miniature, high frequency, modular power transformers.

BACKGROUND ART

Conventional high frequency power transformers that require high voltage isolation between primary and secondary windings are usually manufactured as an integral assembly that requires labor intensive winding of the primary and secondary windings, leading to high costs. Conventional devices further require potting or special coating for the transformer to meet standard industry dielectric withstand specifications, such as U.L. 1244, ANSI C39.5 or IEC 348.

Therefore, it is an object of the present invention to provide a miniature high frequency power transformer that is compact and inexpensive to manufacture. It is a further object of the invention to provide a miniature high frequency power transformer that exhibits good magnetic coupling and high voltage isolation to meet standard industry dielectric withstand specifications. Another object of is to provide a miniature high frequency power transformer that utilizes modular components.

DISCLOSURE OF THE INVENTION

The above and other objects of the present invention are satisfied by mating outer and inner modular transformer bobbins carrying respectively the primary and secondary windings of a transformer. The outer modular transformer bobbin has a primary shank portion with a plurality of flanges formed thereon, establishing an area for receiving primary windings of the transformer. The primary shank portion has a first aperture formed therethrough. A end wall of the first aperture has a protrusion extending therefrom axially through the aperture that terminates at one end of the transformer at first core retaining ears. Second core retaining ears extend axially from the opposite end of the transformer.

The secondary shank of the inner modular transformer bobbin is slightly smaller in diameter than the diameter of the first aperture formed in the primary shank, and has an area formed thereon to receive secondary windings of the transformer. The secondary shank further has a second aperture extending axially therethrough that is slightly larger in diameter than the diameter of the first protrusion formed in the primary shank.

The secondary shank is inserted into the first aperture formed in the outer bobbin, with the first protrusion extending from the primary shank inserted into the second aperture formed in the secondary shank such that the secondary windings on the secondary shank are within the primary windings formed on the primary shank.

A highly permeable transformer core is supported within the first and second core retaining ears and surrounds the inner and outer modular transfomer bobbins.

The modular design of the miniature high frequency power transformer minimizes assembly errors that may compromise protective dielectric spacings necessary to meet industry safety standards.

Furthermore, forming the windings on the inner and outer modular transformer bobbins can be carried out in advance by automated equipment further minimizing human error and reducing costs. No transformer potting or special coating is required in the assembly of the present invention.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modification in various obvious respects, all without departing from the invention. Accordingly, the drawing and description are to be regarded as illustrative in nature, and not as restrictive.

BRIEF DESRIPTION OF THE DRAWINGS

BEST MODE FOR CARRYING OUT THE INVENTION

Figure 1:
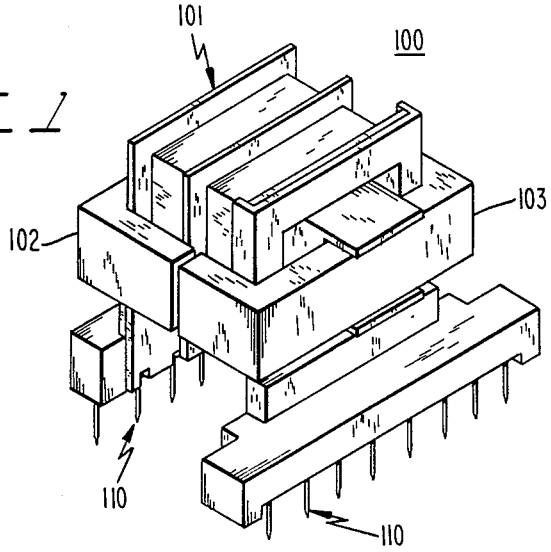
FIG. 1 is a perspective view of an assembled transformer in accordance with an embodiment of the present invention.
Figure 2:
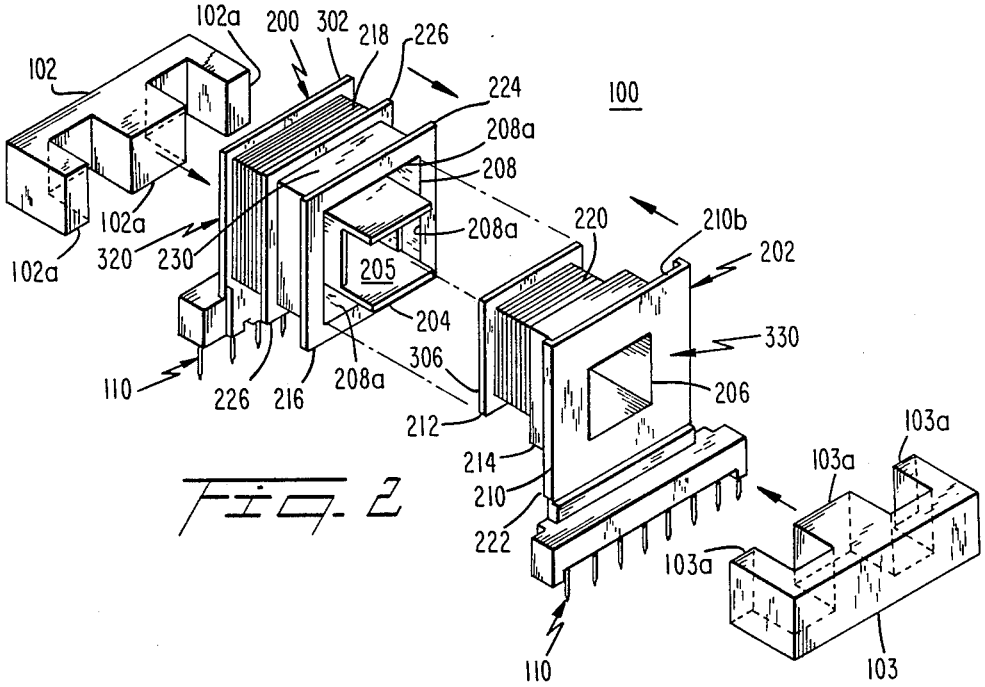
FIG. 2 is an exploded view of a transformer of FIG. 1, showing inner and outer modular transformer bobbins and corresponding ferrite core halves.
Figure 3:
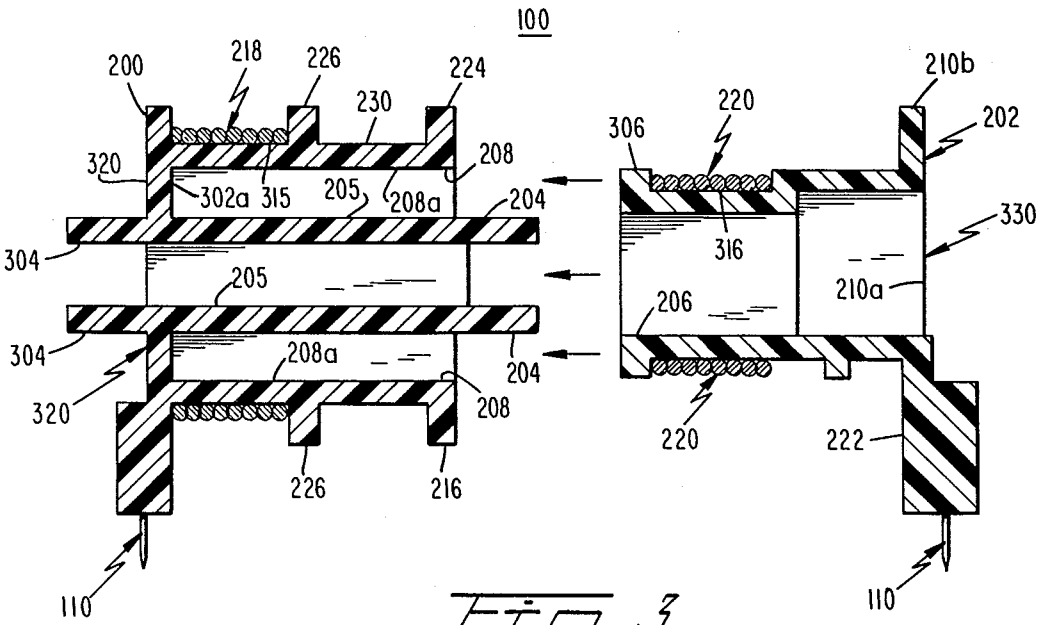
FIG. 3 is an enlarged cross sectional side view of the inner and outer modular transformer bobbins before assembly.

Referring to FIGS. 1–3, a miniature high frequency power transformer 100, in accordance with a preferred embodiment of the invention, comprises an outer modular transformer bobbin 200 having primary windings 218 formed thereon, an inner modular transformer bobbin 202 having secondary windings 220 thereon and first and second ferrite core halves 102 and 103 surrounding both bobbins. The outer modular transformer bobbin 200 further has a primary shank portion 230 with a first flange 302 at one end of the shank, a second flange 226 centered on the shank, and a third flange 224 on the opposite end. The two bobbins 200, 202 are preferably formed of a plastic material.

The first flange 302 has first transformer core retaining ears 304 (FIG. 3) formed thereon that extend axially from one end of transformer face 320. Second flange 226, formed midway between flanges 302 and 224 on shank 230, creates an area 315 that receives the primary windings 218. Third flange 224 is formed on the shank 230 with an aperture 208 therein that is defined by wall **208*a* (FIG. 2). A protrusion 205 extends from an end wall 302*a* on flange 302 axially through aperture 208, to form second core retaining ears 204 at the opposite end of the transformer. Inner modular transformer bobbin 202 has a secondary shank portion 214 that receives secondary windings 220 at an area 316. First mating flange 212 is formed on secondary shank 214 with aperture 206** therein.

It should be noted from FIG. 3 that aperture 206 has the same shape and is slightly larger in diameter than the diameter of protrusion 205. A secondary retaining wall **210*a* is formed on secondary shank 214 by a flange 202 having secondary lips 210b thereon. The secondary lips 210*b* (See FIG. 2) have the same inside dimensions as third flange 224 on the outer transformer bobbin 200**.

Aperture 206 of wall 210*a* has a diameter slightly larger than the diameter of protrusion 205. Both the outer modular transformer bobbin 200 and the inner transformer bobbin 202 have electrically conductive mounting pins 110 thereon that are capable of mounting and electrically interconnecting the miniature high frequency transformer 100 to a circuit board (not shown).

"E" shaped ferrite core halves 102 and 103 (FIG. 2) are identical to each other and provide a highly efficient flux path between the primary windings 218 and secondary windings 220. Ferrite core halves 102 and 103 further act to maintain outer transformer bobbin 200 and inner transformer bobbin 202 assembled together to form the miniature high frequency transformer 100 as hereinafter described.

In the assembly of the preferred embodiment of the invention shown in FIG. 1, referring additionally to the enlarged view of the inner and outer modular transformer bobbins 200 and 202 shown in FIG. 3, bobbins 200 and 202 are positioned such that first mating flange 212 on inner modular bobbin 202 faces third flange 224 on outer modular transformer bobbin 200. Protrusion 205 on bobbin 200 is then aligned with aperture 206 on bobbin 202, and first mating flange 212 is inserted into aperture 208 on bobbin 200 such that shank 214 interfits with aperture 208. Protrusion 205 is moved axially through aperture 206 until first mating flange 212 comes into contact with primary retaining wall 302*a;* likewise third flange 224 is adjacent secondary retaining wall 210a and lips 210b. First core retaining ears 304 (FIG. 3) extend from primary face 320 and second core retaining ears 204 extend from secondary face 330.

Center portion 102*a* of first core half 102 (FIG. 1) is next inserted into aperture 205 at primary face 320 until first core half 102 is retained by first core retaining ears 304. Similarly, center portion 103*a* of second core half 103 is inserted into aperture 206 at secondary face 330 of inner transformer bobbin 202 until core half 103 is retained by second core retaining ears 204, and core faces 102*a* and 103*a* on the first and second ferrite core halves, respectively, are face to face, to be bonded together to form the assembly of FIG. 1.

It should be understood that when miniature high frequency transformer 100 is thus assembled, secondary windings 220 are contained within primary windings 218 formed on outer modular transformer bobbin 200 and both primary windings 218 and secondary windings 220 are surrounded by first and second ferrite core halves 102 and 103 (See FIG. 1). Of course, the positions of the primary and secondary windings can be interchanged. This close fitting relationship between the windings and the core halves maximizes coupling of the windings to the highly permeable ferrite core and minimizes flux leakage. Once assembled, first and second ferrite core halves 102 and 103 are bonded together by any suitable bonding agent (not shown) applied to first and second core faces 102*a* and 103*a*.

There has accordingly been described a miniature high frequency power transformer wherein magnetic coupling is maximized by the utilization of low cost and easily assembled modular transformer bobbins. Modular assembly and close manufacturing tolerances meet or exceed industry safety standards for high voltage isolation for high frequency power transformers.

In this disclosure, there is shown and described only the preferred embodiment of the invention, but, it is to be understood that the invention is capable of use in various other combinations and environments and is capable of changes or modifications within the scope of the inventive concept as expressed herein.

What is claimed is

1. A miniature high frequency power transformer, comprising:

a highly permeable transformer core;

inner and outer modular transformer bobbins comprising, respectively, a primary shank and a secondary shank;

said primary shank having a plurality of flanges formed thereon, said flanges establishing an area for receiving primary windings of said transformer, said primary shank having a first aperture formed therethrough, an end wall of said first aperture having a protrusion extending therefrom axially through said aperture and terminating at one end of said transformer at first core retaining ears;

second core retaining ears extending from an opposite end of said transformer; and said secondary shank slightly smaller in diameter than the diameter of the first aperture formed in the primary shank, and having an area thereon receiving secondary windings of said transformer, said secondary shank having a second aperture extending axially therethrough that is slightly larger in diameter than the diameter of the first protrusion formed in the primary shank;

said secondary shank of said inner modular transformer bobbin inserted into said first aperture formed in said primary shank, with said first protrusion extending from said primary shank inserted into said second aperture formed in said secondary shank so that said secondary windings on said secondary shank are within said primary windings formed on said primary shank;

said highly permeable core supported within said first and second core retaining ears surrounding said inner and outer modular transformer bobbins.

2. The transformer of claim 1, wherein the highly permeable transformer core comprises first and second identical core halves joined together around said inner and outer bobbins.

3. The transformer of claim 2, wherein said core halves are retained in said first and second retaining ears, respectively.

4. The transformer of claim 2, wherein said core halves are comprised of ferrite.

5. The transformer of claim 3, wherein ends of said first and second core halves are bonded together.

6. The transformer of claim 1, wherein said transformer further comprises means for mounting said transformer on a circuit board.

7. The transformer of claim 6, wherein said means for mounting said transformer comprise a plurality of pins, at least one of said pins being electrically conductive.

8. The transformer of claim 1, wherein said first and second bobbins are formed of a plastic material.

9. A miniature high frequency power transformer, comprising:

first and second "E" shaped ferrite core halves;

inner and outer modular transformer bobbins having, respectively, a primary shank and a secondary shank;

said primary shank having a plurality of flanges thereon forming an area for receiving primary windings of said transformer;

said primary shank having a first aperture formed therethrough, a protrusion extending axially from an endwall of said first aperture and terminating in first transformer core retaining ears at one end of said transformer;

second core retaining ears extending from said primary shank at the opposite end of said transformer;

said secondary shank slightly smaller in diameter than the diameter of the aperture formed in the primary shank and forming an area for receiving winding secondary windings of said transformer;

said secondary shank having a second aperture formed therethrough that is slightly larger in diameter than the diameter of the first protrusion formed in the primary shank;

said secondary shank of said inner modular transformer bobbin inserted into said first aperture formed in said primary shank of said outer modular transformer bobbin, with said protrusion extending from said primary shank inserted into said second aperture formed in said secondary shank such that said secondary windings formed on said secondary shank are within said primary windings formed on said primary shank;

said first and second "E" shaped ferrite core halves surrounding said inner and outer modular transformer bobbins with central stems of said core halves inserted with said first and second apertures, respectively; and a plurality of electrically conductive pins for mounting said transformer on a circuit board.

* * * * *

UNITED STATES PATENT AND TRADEMARK OFFICE

CERTIFICATE OF CORRECTION

PATENT NO. : 4,857,878

DATED : August 15, 1989

INVENTOR(S) : Benjamin Eng, Jr. and Margaret Winsor

It is certified that error appears in the above-identified patent and that said Letters Patent is hereby corrected as shown below:

On the title page, insert the following:

--Assignee: John Fluke Mfg. Co., Inc., Everett, WA--;

and

--Attorney, Agent or Firm: George T. Noe, Stephen A. Becker, Mikio Ishimaru--.

Signed and Sealed this

Twenty-fourth Day of July, 1990

*Attest:*

HARRY F. MANBECK, JR.

*Attesting Officer*

*Commissioner of Patents and Trademarks*